United States Patent [19]

Ditzig

[11] Patent Number: 4,673,228

[45] Date of Patent: Jun. 16, 1987

[54] ROTARY ELECTRICAL CONNECTOR APPARATUS

[75] Inventor: Albert Ditzig, Hoffman Estates, Ill.

[73] Assignee: Telephone Products, Inc., Wheeling, Ill.

[21] Appl. No.: 809,217

[22] Filed: Dec. 16, 1985

[51] Int. Cl.[4] ..... H01R 39/00

[52] U.S. Cl. ..... 439/21; 439/13; 439/638

[58] Field of Search ..... 339/5, 176 M, 205, 207, 339/206, 8 R, 154 A, 8 P, 8 PB; 179/178

[56] References Cited

U.S. PATENT DOCUMENTS

| | | | |
|---|---|---|---|
| 3,243,866 | 4/1966 | Pandapas et al. | 339/5 M X |
| 3,430,180 | 2/1969 | Brown | 339/8 R |
| 3,437,976 | 4/1969 | Nelson | 339/8 R |
| 4,438,998 | 3/1984 | Myers | 339/154 A |
| 4,472,010 | 9/1984 | Parnello | 339/8 R |
| 4,533,796 | 8/1985 | Engelmore | 339/8 R X |
| 4,583,797 | 4/1986 | Engelmore et al. | 339/8 R X |
| 4,583,798 | 4/1986 | Blazowich | 339/8 P |

*Primary Examiner*—Eugene F. Desmond
*Attorney, Agent, or Firm*—McCoy Morris & Kula

[57] ABSTRACT

A rotary electrical connector apparatus for receiving and transmitting electrical energy. The apparatus comprises a hollow housing having opposite ends and a centrally located longitudinal axis of rotation and each opposite end has an opening. A spindle has a first section and a second section. Means on the housing and spindle cooperate to mount the spindle and housing for rotation about the longitudinal axis independently of each other. A plurality of electrical conducting means through the spindle rotate with the spindle. Each of the electrical conducting means comprises a first portion contiguous to the outer surface of the spindle's first section and a second portion extending longitudinally through the spindle's second section. A plurality of electrical contact means each having opposite ends is mounted for rotational movement with the housing. Means at one end of each electrical contact means engage the contact means with electrical energy receiving means. Means at the other end of each electrical contact means engage electrical conducting means contiguous to the outer surface of the spindle's first section and maintain the electrical engagement during rotation of the spindle and housing relative to each other. Second portion of the electrical conducting means comprises means for electrically connecting the conducting means to the electrical energy transmitting means. The connector apparatus is used between a telephone and handset cord and prevents the handset cord from becoming twisted.

31 Claims, 27 Drawing Figures

FIG. 6
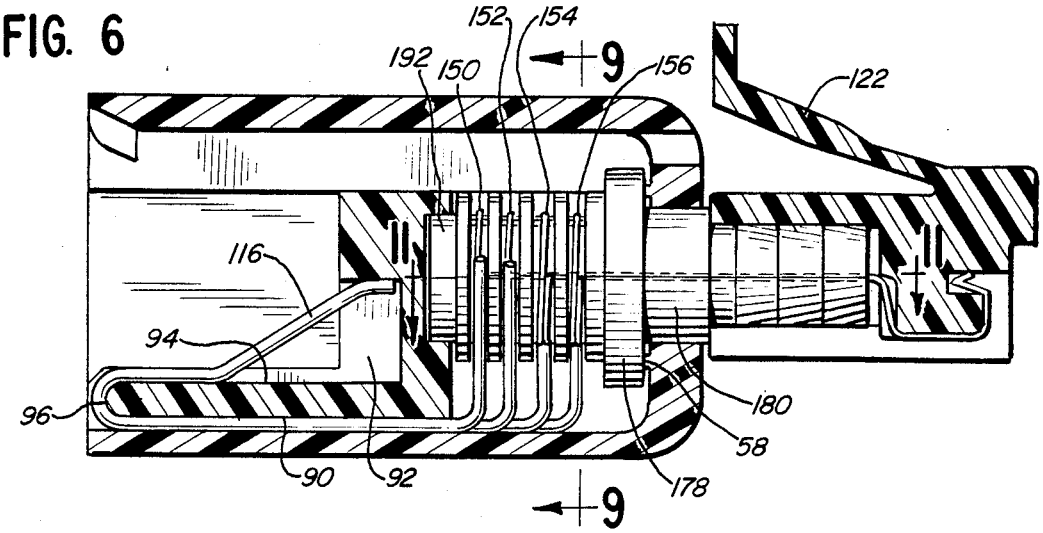
FIG. 7
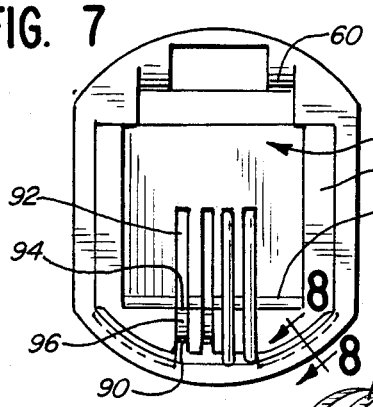
FIG. 8
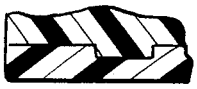
FIG. 9
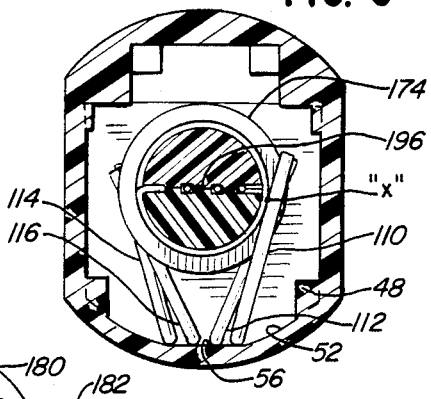
FIG. 10
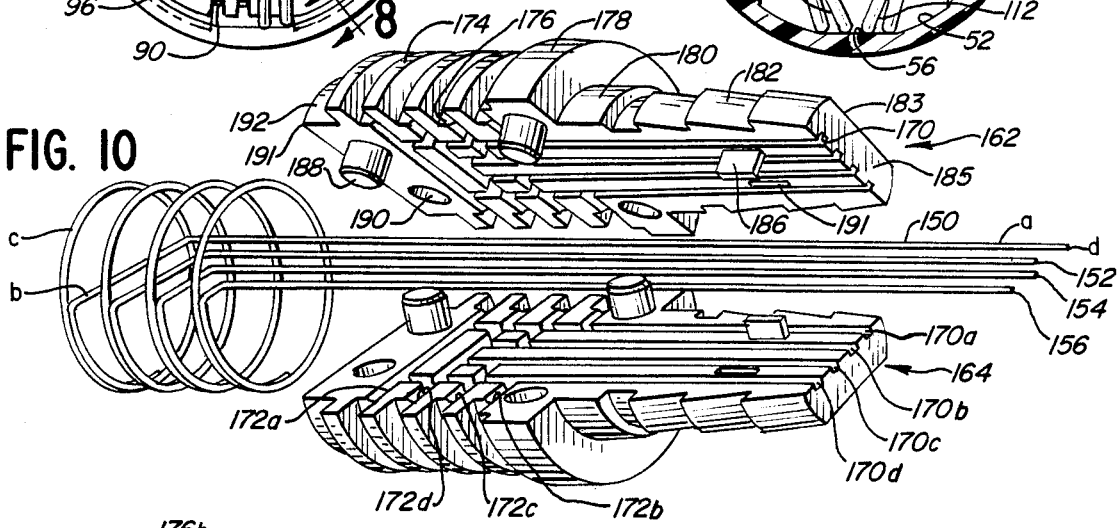
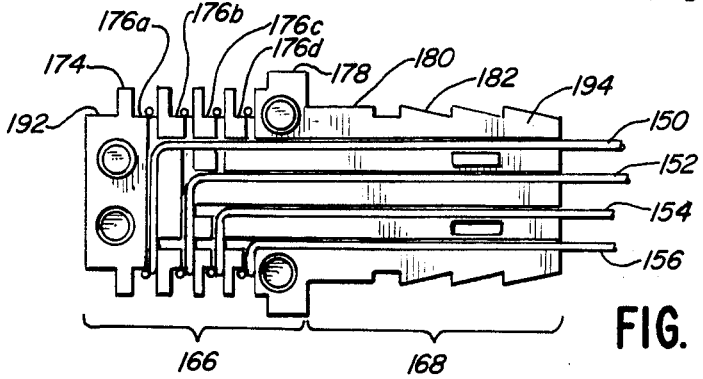
FIG. 11

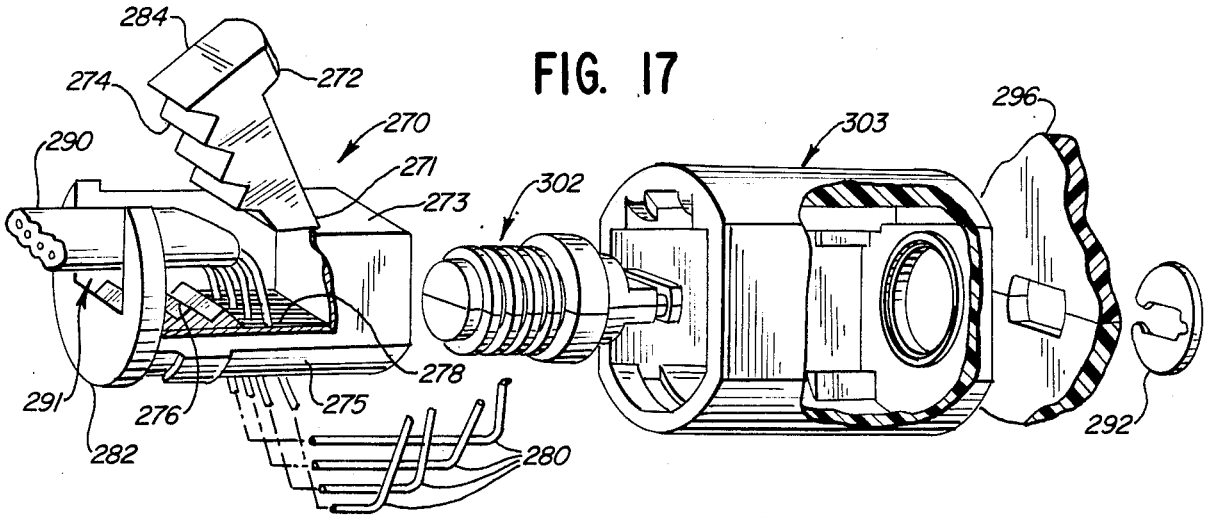
FIG. 17
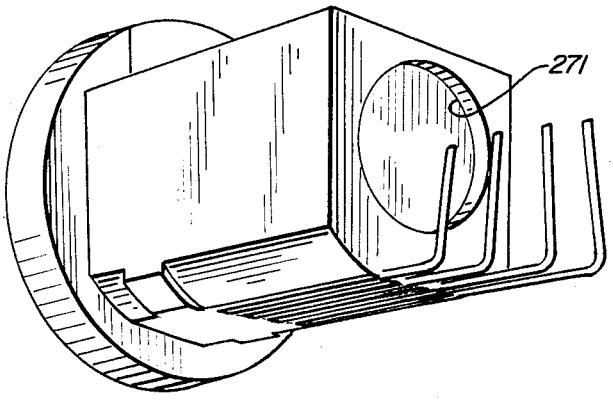
FIG. 18
FIG. 19
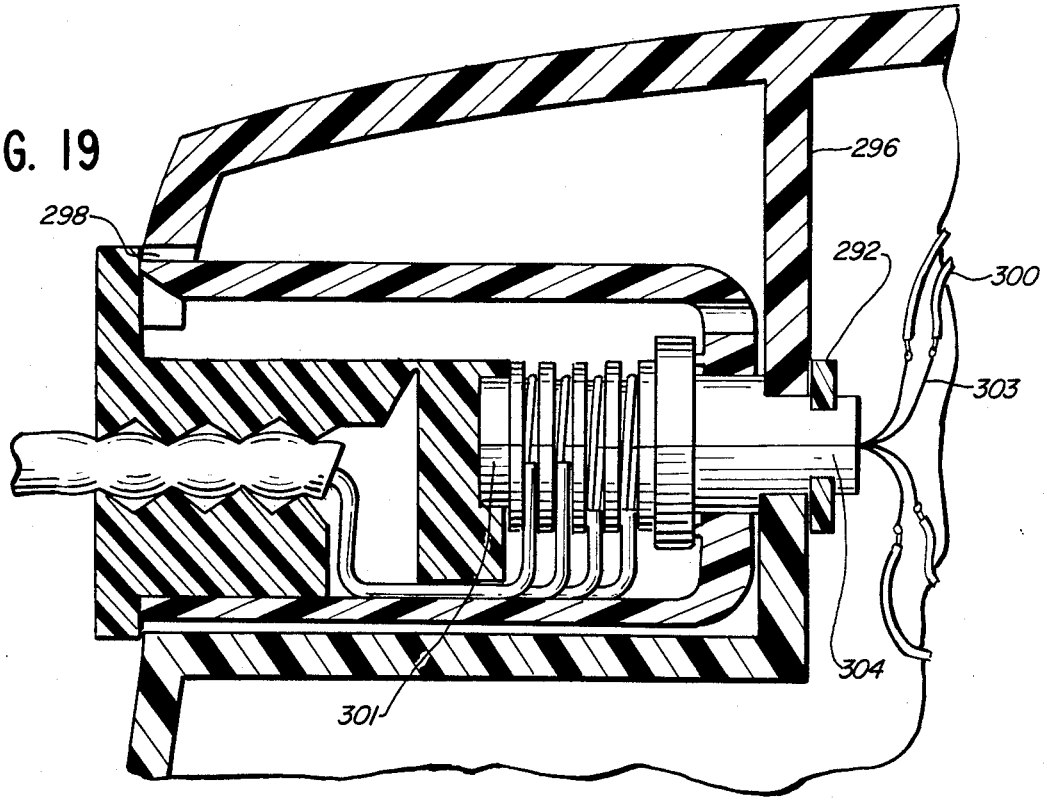

FIG. 22
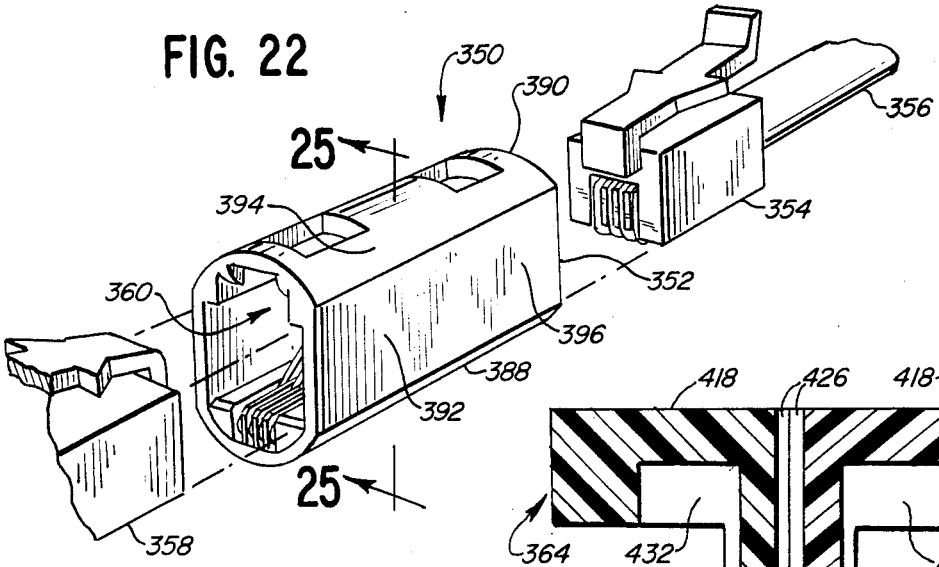
FIG. 23
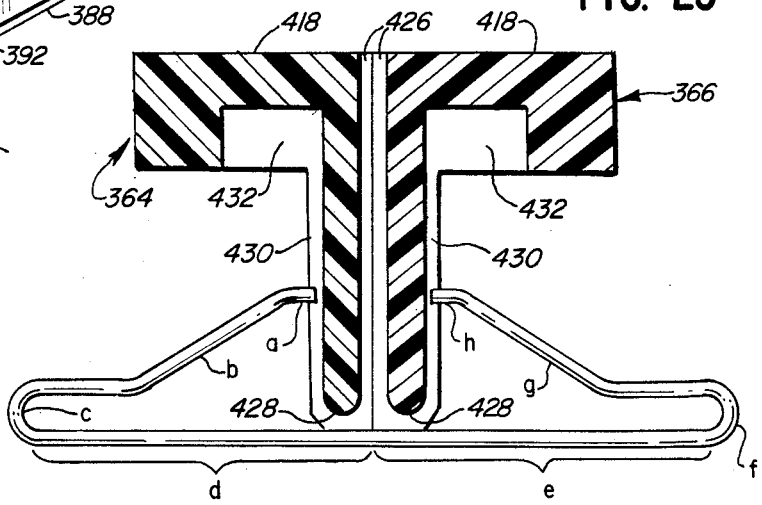
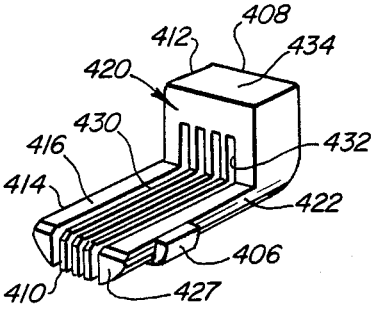
FIG. 27
FIG. 24
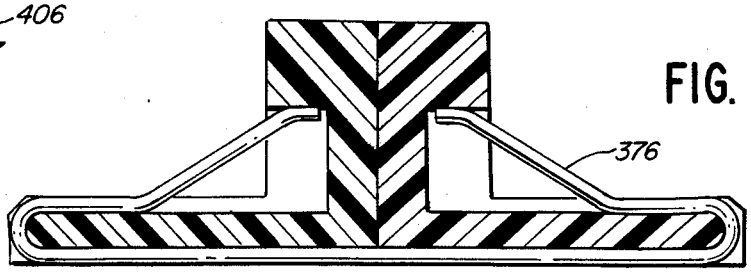
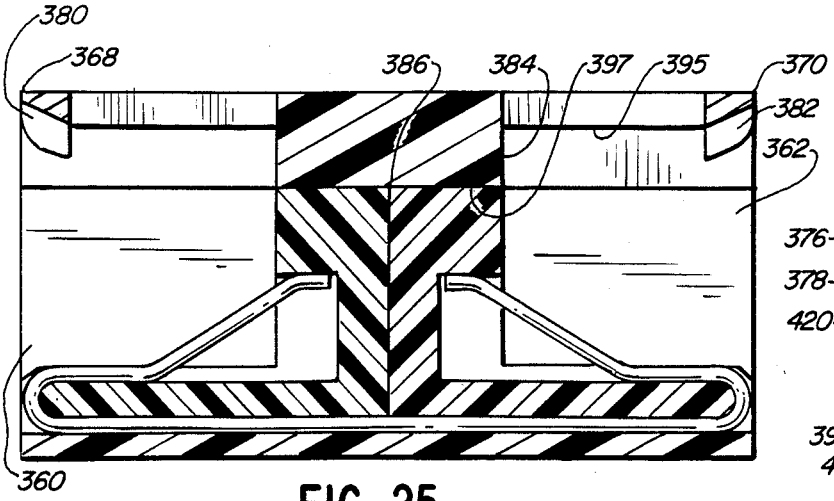
FIG. 25
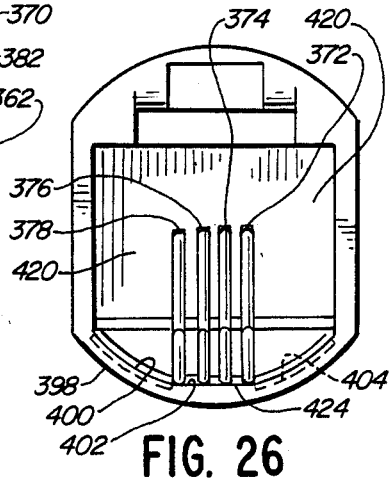
FIG. 26

ROTARY ELECTRICAL CONNECTOR APPARATUS

BACKGROUND OF THE INVENTION

1. Field of the Invention

The apparatus of the subject invention pertains to a rotary electrical connector which is releasably mounted between the telephone cord and the handset. The apparatus will prevent the cord from becoming severely twisted or tangled regardless of the number of times the handset is rotated.

2. Description of the Prior Art

Telephone handset cords constantly twist or tangle when used over an extended period of time. A severely twisted cord looks unsightly, interferes with normal telephone use and becomes permanently deformed. What is needed is a small, light weight and unobtrusive rotary electrical connector which is easily releasably mountable to the "plug-in" type of handset cord and the handset to prevent the tangling of the handset cord during the normal use of the telephone.

While rotary electrical connector devices have been disclosed in the prior art, nowhere is there disclosed a rotary electrical connector for use with a modern "plug-in" type of telephone and which is releasably mounted to the telephone handset cord and to the handset.

SUMMARY OF THE INVENTION

A rotary electrical connector apparatus for receiving electrical energy and for transmitting electrical energy. The apparatus comprises a hollow housing having opposite ends and a centrally located longitudinal axis of rotation and each oposite end has an opening. A spindle has a first section and a second section. The first spindle section has a circular cross sectional area and an outer surface. The spindle also has longitudinal axis of rotation which coincides with the longitudinal axis of the housing. Means are on the housing and spindle which cooperate to mount the spindle and housing together for rotation about the longitudinal axis. The rotation of the spindle and housing are independent of each other. Means are provided for preventing the longitudinal movement of the spindle in the direction of one end of the housing. A plurality of electrical conducting means are provided for conducting electrical energy through the spindle and which are rotatable with the spindle. Each of the electrical conducting means comprises a first portion contiguous to the outer surface of the spindle's first section and a second portion extending longitudinally through the spindle's second section. A plurality of electrical contact means each having opposite ends are provided. Means mounting the electrical contact means for rotational movement with the housing are provided. Means are provided at one end of each electrical contact means for electrically connecting the contact means with electrical energy receiving means. Means are provided at the other end of each electrical contact means for electrically engaging the electrical conducting means contiguous to the outer surface of the spindle's first section and for maintaining the electrical engagement during rotation of one of the spindle and housing relative to each other. The second portion of the electrical conducting means comprises means for electrically connecting the conducting means to the electrical energy transmitting means. The connector apparatus is preferably used by releasably mounting the plug end of a telephone handset cord into the opening of the apparatus and then releasably mounting the plug end of the apparatus into the opening of the handset. The plug end of the connector apparatus can also be inserted into the opening of the base of the telephone. Once mounted, the apparatus prevents the handset cord from becoming tangled.

In another embodiment of the apparatus of the present invention, the plug member of the apparatus is preferably attached to a flexible 2 inch to 3 inch long wire cable. This design permits the handset to rest on the phone base without interfering with the connector apparatus which may be due to the unique design of the particular telephone.

In a third embodiment of the apparatus of the present invention, the connector apparatus is permanently mounted within the mouthpiece portion of the body of the handset. The handset cord can either be releasably mounted into the connector apparatus or it can be permanently connected into the connector apparatus.

In a fourth embodiment of the apparatus of the present invention, the connector apparatus is preferably releasably mounted into the base of the telephone. The plug end of the connector apparatus is perpendicular to the longitudinal axis of rotation of the housing to facilitate the independent rotation of the housing with respect to the plug end especially when the apparatus is attached to the base of a telephone.

The apparatus is approximately one inch long by one half inch wide. It is preferably molded out of plastic. All electrical contact and conduction wires are made out of a corrosive resistive material or are gold plated to prevent corrosion and to ensure proper electrical conduction.

The apparatus is durable, light weight, and economical to manufacture.

In a fifth embodiment of the apparatus of the present invention, two electrical contact mounting means are mounted within the hollow housing together with electrical contact means to provide a telephone cord coupling apparatus which connects the plug ends of two handset cords. Thus, the length of a telephone cord may be increased to any desired length by coupling together two or more cords.

These and other advantages of the invention will become apparent to those of ordinary skill in the art with reference to the drawing and the further detailed description of this invention.

DESCRIPTION OF THE DRAWING

FIG. 6 is an elevational sectional view of the rotary electrical connector apparatus along Line 6—6 of FIG. 1.

FIG. 7 is an elevational end view of the rotary electrical connector apparatus;

FIG. 8 is a sectional view along Line 8—8 of FIG. 7;

FIG. 9 is a sectional view along Line 9—9 of FIG. 6;

FIG. 10 is an exploded perspective view of the spindle member and conduction wires of the rotary electrical connector apparatus;

FIG. 11 is a sectional view along Line 11—11 of FIG. 6

FIG. 17 is an exploded partial cutaway perspective view of a fourth embodiment of the rotary electrical connector apparatus;

FIG. 18 is a perspective view of the insert member and contact wires of the embodiment shown in FIG. 17;

FIG. 19 is an elevational sectional view of the rotary electrical connector apparatus shown in FIG. 17 which is permanently mounted in a handset;

FIG. 22 is an exploded perspective view of a handset cord coupling apparatus;

FIG. 23 is an elevational sectional view of the component parts prior to assembly of the coupling apparatus;

FIG. 24 is an elevational sectional view of the component parts after assembly of the coupling apparatus;

FIG. 25 is an elevational sectional view along line 25—25 of FIG. 22;

FIG. 26 is an end elevational view of the coupling apparatus; and,

FIG. 27 is a perspective view of one of the inserts of the coupling apparatus.

DESCRIPTION OF THE PREFERRED EMBODIMENT

Figures 1, 2, 3, 4, 5:
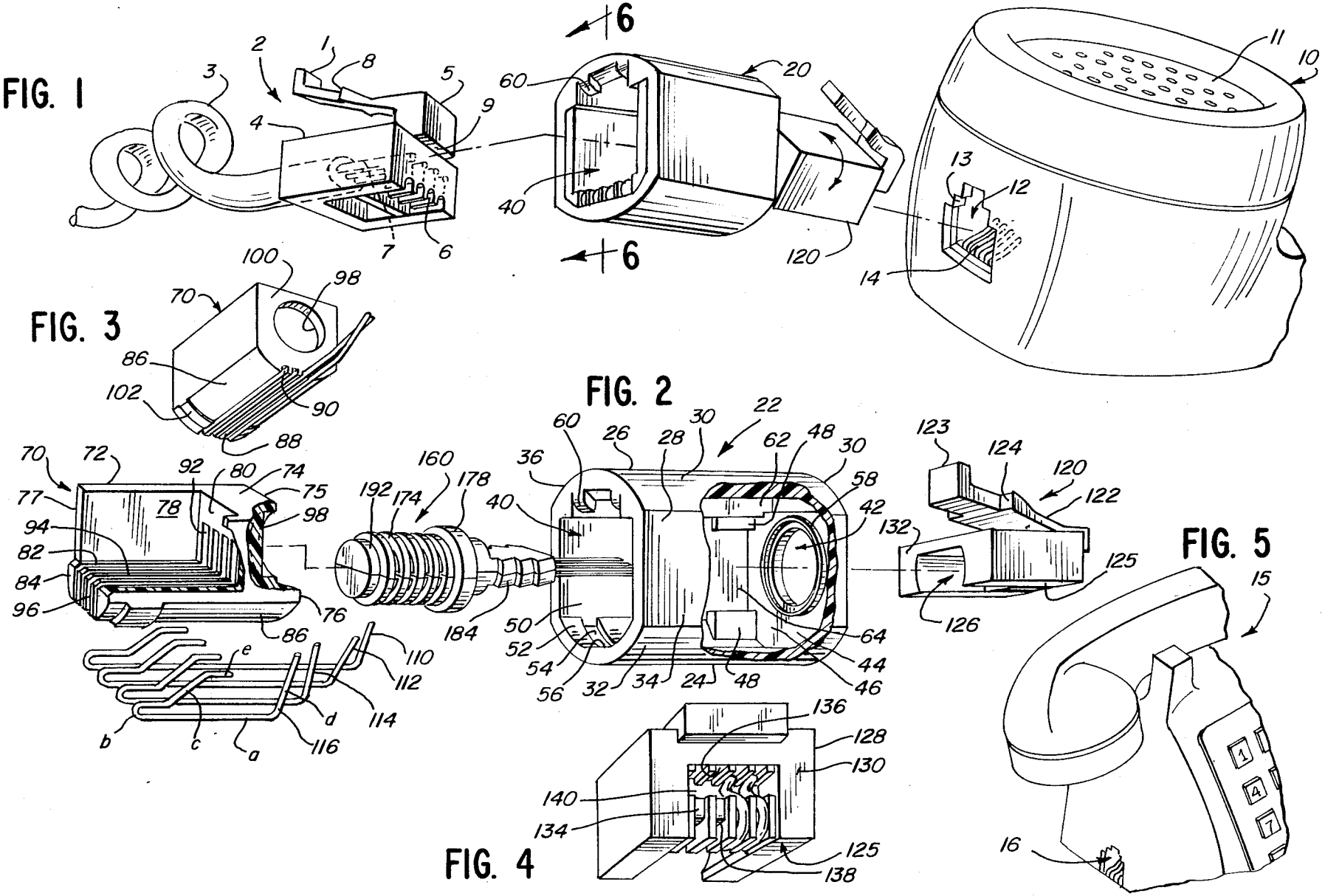
FIG. 1 is an exploded perspective view of the rotary electrical connector apparatus between the handset cord and the handset.
FIG. 2 is an exploded partial cutaway perspective view of the component parts of the rotary electrical connector apparatus.
FIG. 3 is a perspective view of the insert member of the electrical connector apparatus.
FIG. 4 is a perspective view of the plug member of the electrical connector apparatus.
FIG. 5 is a partial cutaway perspective view of a standard push button telephone.

Referring to FIG. 1 there is shown a perspective view of the preferred embodiment of the rotary electrical connector apparatus 20. The electrical energy transmitting means or mouthpiece 11 of telephone handset 10 is normally releasably mounted to electrical energy receiving means or handset cord 2. Handset cord 2 comprises cable 3 which has four transmitting wires 7 mounted at the end thereof to cord plug 4. Plug 4 comprises lever 5 which is integral with the top of plug 4 at point 9. Lever 5 is normally urged in a stationary upward position as shown in FIG. 1. Lever 5 is pressed downward which enables plug 4 to be inserted or removed from opening 12 of mouth piece 11. Plug 4 is inserted into or removed from opening 12 by pressing down on lever 5 so that locking projections 8 of lever 5 are below notches 13 of opening 12. Once plug 4 is inserted into opening 12 so that locking projections 8 are below and behind notches 13, lever 5 is released. The lever then moves upward to its normal stationary position. Locking projections 8 are located behind notches 13 which prevent plug 4 from being removed from opening 12. When plug 4 is inserted into opening 13 grooves 6 of plug 4 are contiguous to four contact wires 14 located in opening 12 which cause an electrical connection between handset 10 and telephone cord 2.

Apparttus 20 is releasably mounted between the electrical energy transmitting means or mouthpiece 11 and the electrical energy receiving means or handset cord 2 by first removing plug 4 from opening 12 as described above. Referring to FIG. 2, plug 120 of apparatus 20 is substantially similar in design to plug 4. Plug 120 is inserted into opening 12 in the same manner as plug 4 is inserted into opening 12. Lever 122 is pressed downward at distal end 123 until locking projections 124 are below notches 13 of opening 12. Plug 120 is then inserted into opening 12 for electrical engagement with wires 14. Lever 122 is then released causing it to move upward to its normal stationary position. Locking projections 124 are now located behind notches 13 of opening 12. Apparatus 20 is thus releasably mounted within opening 12 and cannot be removed from opening 12 unless lever 122 is pressed downward to disengage locking projections 124 with notches 13 of opening 12. After plug 120 is releasably mounted into opening 12, plug 4 is inserted into opening 40 of apparatus 20 in the same manner as plug 4 or plug 120 is inserted into opening 12. Lever 5 is pressed downward at distal end 1 until locking projections 8 are below notches 60 of opening 40. Plug 4 is inserted into opening 40 until locking projections 8 are below and behind notches 60. Lever 5 is then released and returns to its normal stationary position wherein locking projections 8 are behind notches 60. Grooves 6 of plug 4 are contiguous to wire 110, 112, 114 and 116 of apparatus 20 for the electrical engagement of plug 4 with apparatus 20. Thus, cord 2 is electrically engaged with apparatus 20 and apparatus 20 is electrically engaged with handset 10.

After apparatus 20 is releasably mounted to handset 10 and phone cord 2 is releasably mounted to apparatus 20, the rotational movement of handset 10 will be independent of the rotational movement of cord 2. This feature is due to the independent rotational movement of plug member 120 with respect to the rotational movement of housing 22. The movement of housing 22 is identical to the rotational movement of cord 2. Obviously, the independent rotational movement of the handset with respect to cord 2 will substantially prevent any severe tangling or twisting of cord 2 whenever handset 10 is rotated.

Referring to FIG. 2 there is disclosed an exploded perspective view of the component parts of the rotary electrical connector apparatus 20. Hollow housing 22 comprises a bottom section 24, a top section 26, and two wall sections 28. Top section 26 comprises curved top outside surface 30 and bottom section 24 comprises curved bottom outside surface 32. Each wall section 28 comprises outside surface 34. Housing 22 further comprises first opposite end 6 and second opposite end 38. At first opposite end 36 there is plug opening 40 and at second opposite end 38 there is circular opening 42. Second opposite end 38 comprises a wall 44 which comprises inside surface 46. Four location stops 48 are formed within housing 22 along each inside surface 50 of each wall 28. Inside curved surface 52 on bottom section 24 is located on either side of inside flat bottom surface 56 which extends longitudinal through the length fo bottom section 24. Locking groove 54 are located laterally along each inside curved surface 52 near first end 36 of housing 22 each of which mates with locking projection 102 of insert 70. A low friction circular thrust bearing 58 is located along the outside perimeter of opening 42 on inside surface 46 which cooperates with radial bushing 180 of spindle 160 to mount the spindle and housing for rotation about the longitudinal axis of rotation 196 of spindle 160 and for rotation about the longitudinal axis of rotation 64 of housing 22. Two notches 60 are located at first end 36. Ridge 62 is located along the top portion of each inside surface 50 of each wall 28. Wall 44 and opening 42 comprise means for preventing the longitudinal movement of spindle 160 in the direction of end 38 of housing 22.

Referring to FIG. 2 and FIG. 3 there is disclosed a perspective view of insert 70. Insert 70 comprises means for mounting the electrical contact means or wires 110, 112, 114 and 116 for rotational movement with housing 22. Insert 70 comprises one end 75 and another end 77. Insert 70 further comprises two side portions 72, a laterally extending first or rear portion 74 adjacent said end 75, and a longitudinally extending second or bottom portion 76 integral with said first or rear portion 74 and terminating at other end 77. Each side portion 72 comprises an inside surface 78 and rear portion 74 comprises an inside surface 80 and outside surface 100. Bottom portion 76 comprises inner side 82 and outer end side 84. Bottom portion 76 further comprises two curved bottom sides 86 on either side of flat bottom surface 88. There are four longitudinally extending grooves 90 on flat bottom surface 88. There are four laterally extending grooves 96 located on outer side 84. Each groove 96 communicates with a respective groove 90 on outer side 84. There are four longitudinally extending grooves 94 located on the inner side 82 of bottom portion 76. Each groove 94 communicates with a respective lateral groove 96 on outer side 84. There are four laterally extending grooves 92 located along inside surface 80 of rear portion 74. Each groove 92 is aligned with a respective groove 94 on the inner side 82 and communicates therewith. A circular recess 98 is located on outer surface 100 of rear wall 74. Recess 98 receives the terminal end portion or radial bearing 192 of spindle 160 for mounting spindle 160 within housing 22 and for permitting the rotation of radial bearing 192 within recess 98. Lateral locking projection 102 is located along each curved bottom side 86 of bottom portion 76.

Contact wires 110, 112, 114, and 116 have opposite ends and are releasably mounted to insert 70. The contact wires transmit electrical energy from plug 4 to spindle 160, a component part of the apparatus more fully described below. Each contact wire comprises four portions. The first portion of each wire is marked by the letter "a"; the second or connecting portion is marked by the letter "b"; the third or contact portion is marked by the letter "c" and the fourth or terminal portion is marked by the letter "d". Contact portion "c" comprises means for electrically connecting said contact wires with electrical energy receiving means. The configuration of each of contact wire is substantially the same except that the length of portion "a" for each wire varies according to the distance between each respective lateral groove 96 and its respective peripheral groove 176. Terminal portion "d" electrically engages conduction wires 150, 152, 154 and 156 which are mounted to spindle 160 contiguous to outer surface 176 for maintaining electrical engagement during the rotation of one of said spindle and said housing relative to the other. Each contact wire is preferably made out of gold plated copper wire to prevent corrosin and promote electrical conduction. Said wires are preferably a resilient material which normally urges terminal portion "d" into spindle radial groove or surface 176 to electrically engage first portion "c" of conduction wires 150, 152, 154 and 156. First portion "a" of each contact wire is received within a respective longitudinally extending groove 90 on the outer side 88 of second portion 76 of insert 70. Connecting portion "b" is integral with first portion "a" and is received within a respective lateral groove 96 at the other end 77 of second portion 76. Contact portion "c" integral with said connecting portion "b" and extending therefrom toward said one end 75 is normally disposed at an angle having distal part "e" extending at least partially within groove 92 on inner side 80 of first portion 74. Contact portion "c" is composed of a resilient material, such as copper and the like, which is capable of being elastically deformed in an outward direction toward said groove 92 in response to the act of electrically connecting said contact wires with electrical energy receiving means or plug 4. Longitudinally extending grooves 94 and laterally extending grooves 92 comprise means for accomodating contact portion "c" when it undergoes elastic deformation. Terminal portion "d" is integral with said first portion "a" and extends laterally and longitudinally from said first portion "a" to tangentically engage outer surface 176 of spindle 160 of first section 166 at point "X". (See FIG. 9)

Referring to FIG. 2, FIG. 10 and FIG. 11 there is disclosed spindle 160. Spindle 160 comprises first end 191, second end 185, first member 162 and second member 164 (See FIG. 10). A longitudinal axis of rotation 196 lies along the axis of symmetry of spindle 22. Each member comprises a first section 166 and a second section 168 (See FIG. 11). First section 166 is located within housing 22 and second section 168 extends beyond opening 42 of housing end 38. The first and second spindle numbers are identical in structure and design. Referring to FIG. 11, there is disclosed an elevational view of bottom or inner surface 194 of one of the members. Located along surface 194 are four parallel longitudinally extending grooves **170*a*, 170*b*, 170*c*, and 170*d*; and four parallel laterally extending grooves 172*a*, 172*b*, 172*c*, and 172*d* which are disposed perpendicular to the direction of said longitudinal grooves "170". longitudinal grooves 170*a* and 170*d* each intersect or communicate with 172*a*, 172*b*, 172*c*, and 172*d*. Longitudinal grooves 170*b* and 170*c* each intersect lateral grooves 172*b* and 172*c*. Also located on each surface 194 are two circular posts 188, one rectangular projection 186, two holes 190, which receive posts 188, and one slotted hole 191 which receives projection 186**.

First section 166 of members 162 and 164 comprise a plurality of circularly shaped outer surfaces of varying radii. When both members are mounted together first section 166 forms a circular cross sectional area having a plurality of varying diameters. The outside surface of mounted members 162 and 164 comprise four grooves which are formed by five radial insulators 174 and four radial contact areas **176*a*, 176*b*, 176*c*, and 176*d*. The outside radial surface of section 166 further comprises thrust bearing 178, radial bushing 180, and a terminal end portion in the form of a radial bearing 192. Second section 168 of the first and second members 162 and 164 comprise stud plug 184 which is integral with thrust bearing 178. Stud Plug 184 further comprises three press fit grooves 182 and flat outside surface 183**.

Referring to FIG. 10 and FIG. 11, there is disclosed a plurality of electrical conducting means for conducting electrical energy through the spindle and which are rotatable therewith in the form of conduction wires 150, 152, 154 and 156. Each conduction wire comprises four sections or portions. Section "a" of each wire comprises a longitudinally extending section through the spindle's second section which is received within its respective longitudinal groove "170" on surface 194. Section "b" of each conduction wire comprises a laterally extended section which is received within its respective lateral groove "172" on surface 194. Section "c" of each conduction wire is circular in shape and lies within its respective peripheral groove and contiguous to its respective outside radial contact surface "176". The conduction wires are preferably made out of gold pated copper wire on the like to prevent corrosion and to promote electrical conduction therethrough. Distal end portions "d" of each conduction wire comprise means for electrically connecting the conducting wires to the electrical transmitting means.

Referring to FIG. 2 and FIG. 4, there is disclosed a perspective view of connector plug 120 which comprises means mounted to said second spindle section 168 for mechanically engaging second spindle section with electrical energy transmitting means for effecting an electrical connection between portion "a" of the electrical conducting wires and the electrical energy transmitting means as a result of the mechanical engagement. Connector plug 120 comprises lever 122, locking projections 124, bottom surface 125, and longitudinally disposed slotted opening 126 along bottom surface 125. Connector plug 120 also comprises front end 128 and a rear end 132. Front end 128 comprises outside wall 130 and lateral slot 140. Grooves 134 and 138 are located along surface 130 and 125, respectively, and grooves 136 are located along the top of slot 140. Plug 120 comprises means mounting spindle 160 for rotational movement relative to said housing together with the electrical energy transmitting means.

The component parts of the apparatus are assembled in the following manner. Conduction wires 150, 152, 154, and 156 are each placed in one of the first or second members 162 or 164 by laying each respective wire, which is pre-formed in the shape of an "L", in its respective longitudinal and lateral groove. Section "b" of each conduction wire must face in the same direction when placed in its respective lateral groove "172". A second spindle member is then press mounted to the first member which is holding the conduction wires. Each portion of each conduction wire which extends beyond its respective lateral groove is then tightly wrapped within its respective peripheral radial groove which is contiguous to its respective radial contact area "176" to form circular section "c".

Referring to FIG. 6, each contact wire 110, 112, 114 and 116 is attached to insert 70 by sliding each wire onto its respective grooves 94, 96 and 90 of insert 70. The distal end of each contact portion "c" of each wire rests partially within lateral groove 92 in insert member 70. Connecting portion "b" of each contact wire rests in lateral groove 96 and first portion "a" of each wire is received within groove 90. Portion "a" for wire 110 is equal to the distance from connecting portion "b" to radial contact surface 176*d* of spindle 160. The length of each other portion "a" is equal to the distance from its respective connecting portion "b" to its respective peripheral groove "176" on spindle 160. Once all contact wires are attached to insert 70, spindle 160 is attached to insert 70 by inserting terminal end portion 192 into recess 98 and placing terminal portions "d" of each contact wire in each of their respective peripheral grooves. Thus, referring to FIG. 11, wire 110 lies within groove a; wire 112 lies within groove b; wire 114 lies with groove c; and wire 116 lies within groove d. Section d of each contact wire rests tangentially against its respective radial contact area 176 at point "X" (See FIG. 9). Once insert 70 and spindle 160 are placed into housing 22, through opening 40 location stops 48 along inside surface 50 of each vertical wall 28 prevent the longitudinal movement of insert 70 in the direction of opening 42. The longitudinal movement of insert 70 in the direction of opening 40 is prevented since insert 70 is locked into its position in housing 22 by locking groove 54 and locking projection 102. After insert 70 and spindle 160 are placed in housing 22, shank portion 184 of spindle member 160 extends through and beyond opening 42 of wall 44. (See FIG. 6) Plug 120 is then connected to shank portion 184 and glued or spot welded thereon. Extending portion "d" of each conduction wire is then wrapped around its respective grooves 138 and 134 of plug 120, and said distal end portions of the wires are then fitted into slot 140 and grooves 136 of plug 120. (See FIG. 4).

Referring to FIG. 6, thrust bearing 178 of spindle 160 rests contiguous to low friction thrust bearing 58 of housing 22 to provide low surface friction between wall 44 and bearing 178 during rotation and also constitutes means for preventing the longitudinal movement of first spindle section 166 through opening 42. Bearing 180 of spindle 160 is located within opening 42 of housing 22.

After assembly of the component parts of the apparatus, spindle 160 and plug 120 rotate simultaneously and independently of the simultaneous rotation of housing 22, insert member 70, and contact wires 110, 112, 114 and 116. The apparatus provides an uninterrupted electrical connection between insert member 70 and plug 120 regardless of the rotational movement of housing 22 and plug 120.

Figure 12:
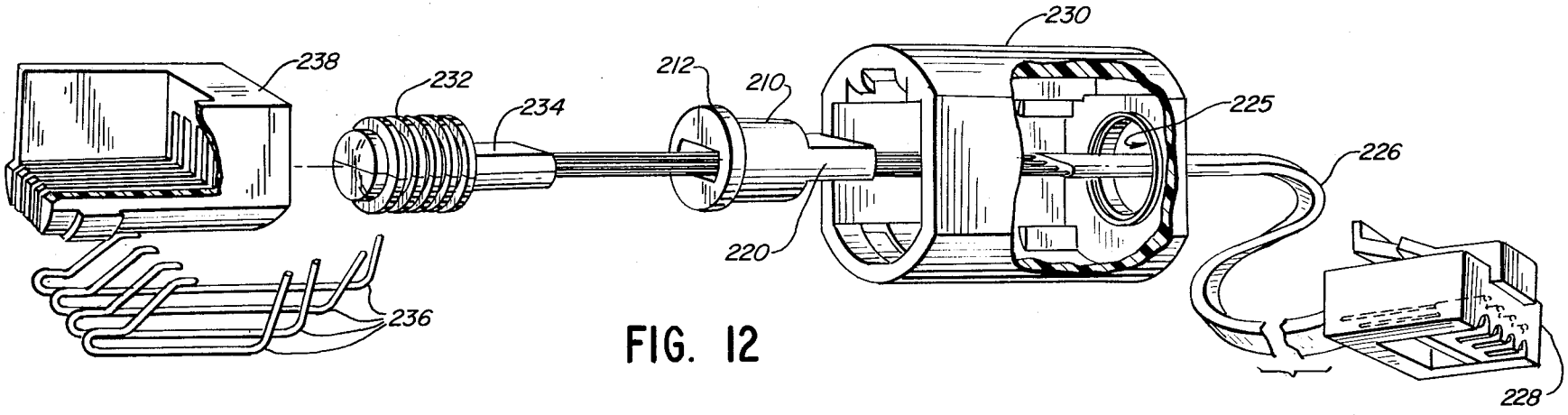
FIG. 12 is an exploded partial cutaway perspective view of a second embodiment of the rotary electrical connector apparatus.
Figure 13:
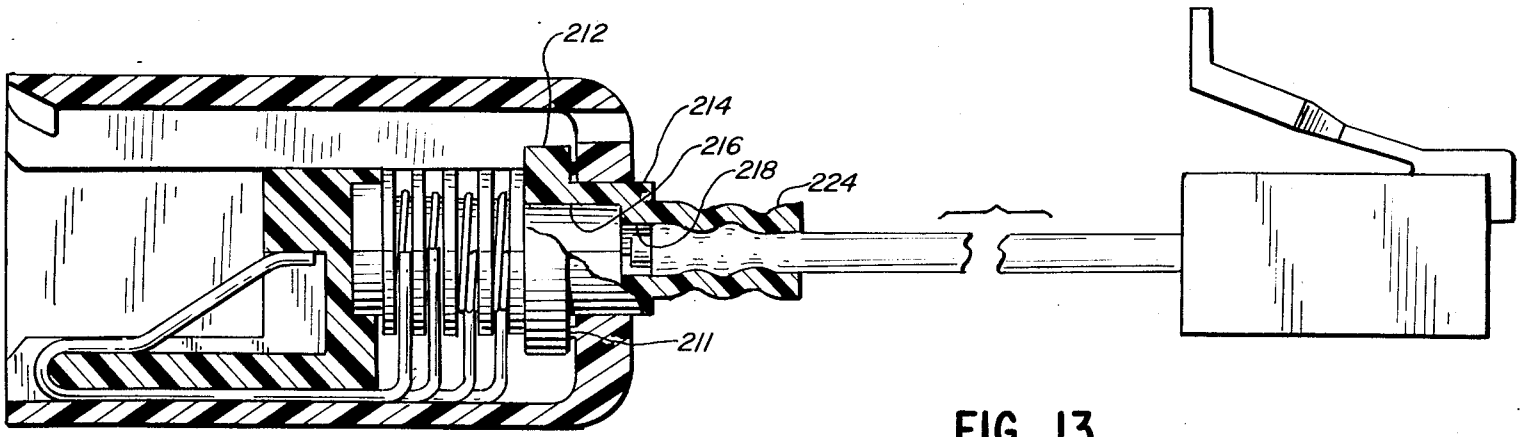
FIG. 13 is an elevational partial cutaway sectional view of the rotary electrical connector apparatus disclosed in FIG. 12.

Referring to FIG. 12 and FIG. 13, there is disclosed a second embodiment of the apparatus of the subject invention. The major difference between the second embodiment and the preferred embodiment is that plug member 228 is connected to flexible cord 226 rather than directly to shank portion 234 of spindle 232. The purpose of this alternate design is to prevent the interference between the apparatus and the base of the telephone when the handset is placed on the phone base. The apparatus disclosed in FIG. 12 and FIG. 13 further comprises a cable bushing 210. Bushing 210 comprises thrust bearing 212, bushing 214, and cable strain relief section 224. First opening 216 extends partially through bushing 214 to accept shank portion 234 of spindle 232. Opening 216 of cable bushing 210 is of the same configuration shape as shank portion 234 so that bushing 210 rotates simultaneously with spindle 232. The apparatus is assembled in substantially the same manner as the apparatus of the preferred embodiment except that cable 226 is placed through bushing 210 and opening 225 before plug 228 is attached to cable 226. Once the apparatus is assembled, cable strain relief portion 224 is crimped to relieve and keep to a minimum any tensile force placed on the conduction wires. The construction, design and assembly of spindle 232, insert 238, housing 230 and contact wires 236 are substantially similar to the construction, design and assembly of the component parts of the preferred embodiment of the apparatus.

Figure 14:
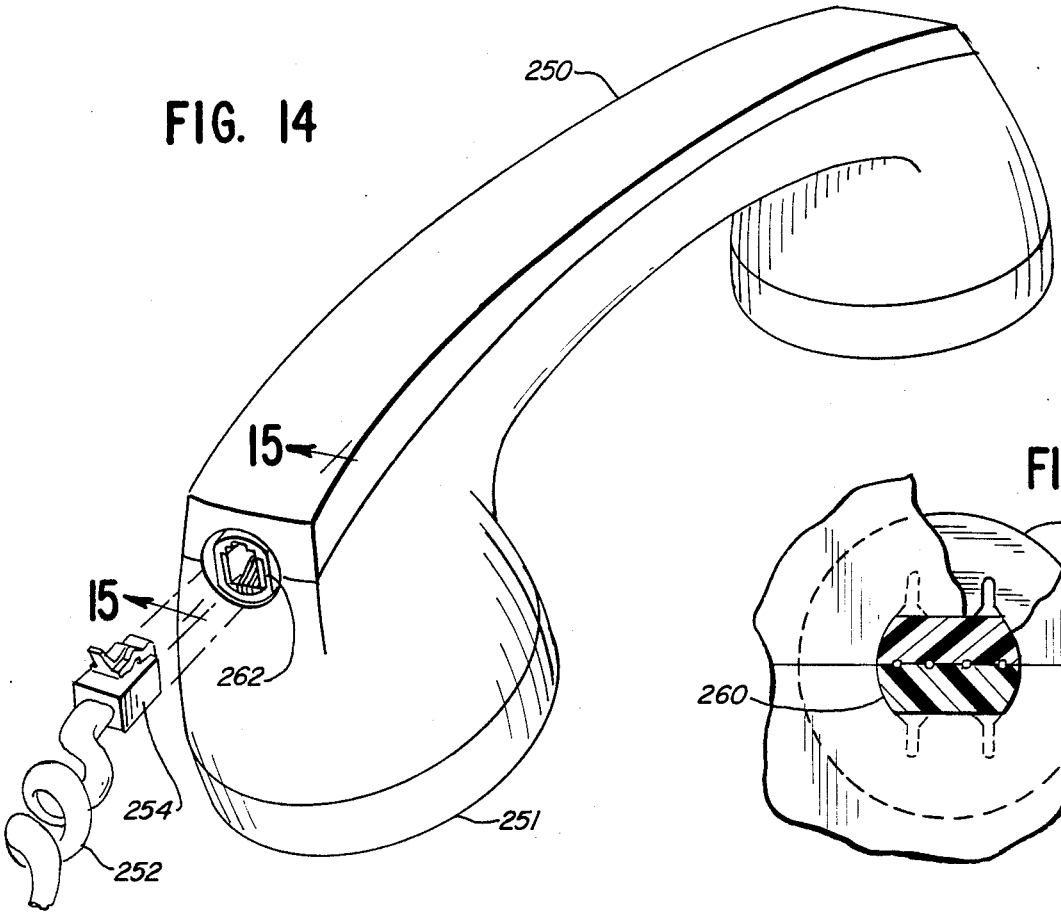
FIG. 14 is a perspective view of the handset cord and a third embodiment of the rotary electrical connector apparatus which is permanently mounted in the mouth piece portion of the handset.
Figure 16:
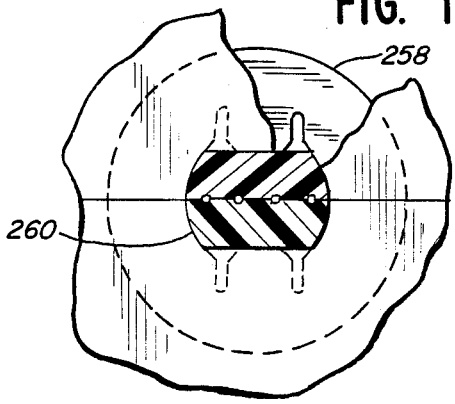
FIG. 16 is a partial cutaway sectional view along Line 16—16 of FIG. 15.
Figure 15:
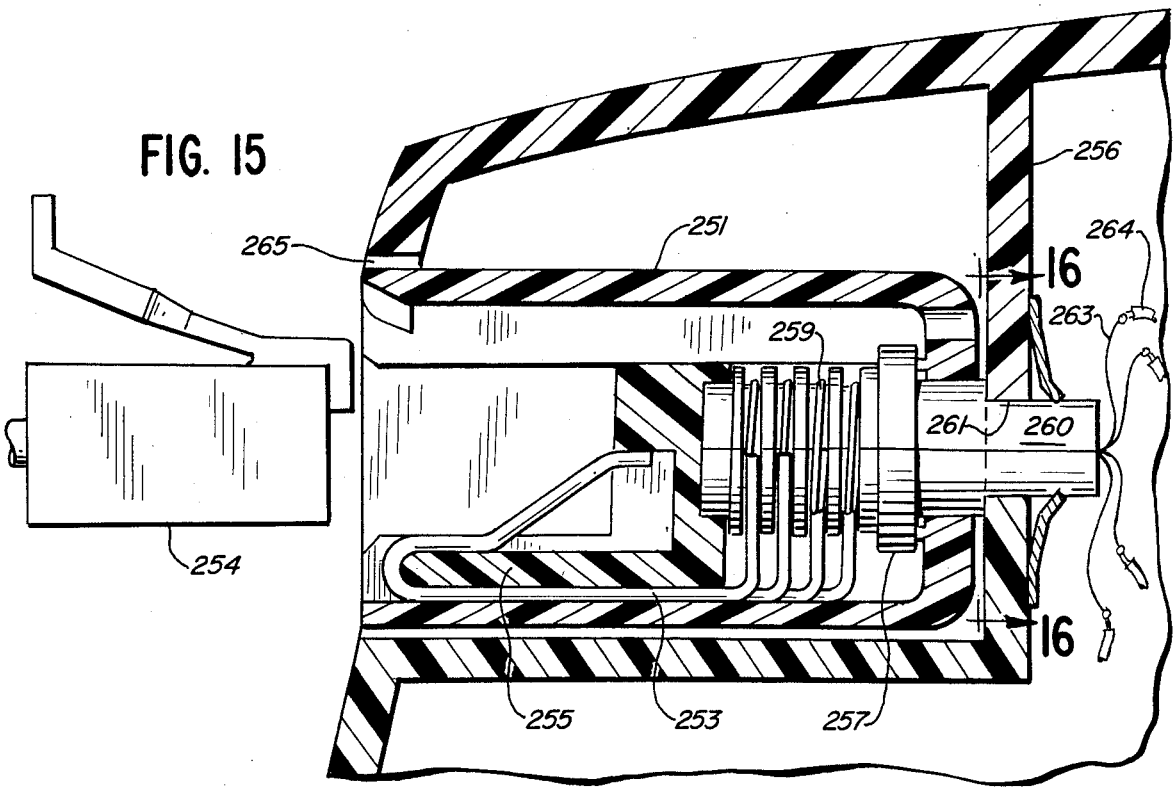
FIG. 15 is an elevational sectional view along Line 15—15 of FIG. 14.

Referring to FIG. 14, FIG. 15, and FIG. 16 there is disclosed a third embodiment of the apparatus of the subject invention. This apparatus is designed to be permanently mounted within mouthpiece portion 251 of handset 250. The construction, design and assembly of housing member 25, contact wires 253, insert 255, spindle 257, and conduction wires 259 are substantially identical to that of the apparatus of the preferred embodiment of the invention, except that shank portion 260 of spindle 257 has a cross sectional area as shown in FIG. 16, and extends through opening 261 of bulkhead 256 of handset 250. Shank 260 is mechanically mounted to bulkhead 256 with a "push on" type retaining ring 258 which prevents the apparatus from moving in the direction of opening 265 of handset 250. This design permits spindle 257 to simultaneously move with the rotational movement of handset 250. Conduction wires 263 are permanently soldered or connected to the internal wires 264 of handset 250. The apparatus disclosed in FIG. 14 and FIG. 15 does not extend past opening 265 of handset 250 and plug 254 is easily releasably mounted thereto in the same manner as previously described above for the apparatus of the preferred embodiment.

Referring to FIG. 17, FIG. 18 and FIG. 19 there is disclosed a second embodiment of the apparatus disclosed in FIG. 14, FIG. 15 and FIG. 16. The embodiment disclosed in FIG. 17 and FIG. 19 is permanently attached or "hard wired" to telephone cord cable 290. Spindle 302, housing 303 and handset 294 are substantially similar to the designs as shown in FIG. 14, FIG. 15 and FIG. 16, except that insert 270 is modified in design to provide a cable strain relief portion. Insert 270 comprises top portion 272 having a saw tooth bottom surface 274, and a bottom portion 275 having a saw tooth top surface 276. Top portion 272 is hinged at top surface 271 of laterally extending first portion 273. Top portion 272 moves in a first open position (See FIG. 17) and a second closed position. (See FIG. 19). The telephone cord or cable 290 is inserted into opening 291 of front part 282 and the bare wires 280 are then fed through slotted grooves 278 which extend through the top and bottom surface of bottom portion 275. Top portion 272 is pressed downward into its second closed position which crimps and holds the cable in the "saw" teeth between the top and bottom portions thereby preventing the cable from being accidently pulled out of the apparatus.

FIG. 18 discloses an end perspective view of insert 270. Radial bearing 301 of insert 302 rotatably fits in recess opening 271 and shank 304 is mounted to bulkhead 296 of handset 294 by the use of a "C" clip retainer 292 or the like. Spindle 302 will rotate simultaneously with the movement of handset 294 and it canot move in the direction of opening 298 of handset 294. Conduction wires 303 are soldered or connected to handset wires 300 to complete the electrical connection.

Figure 20:
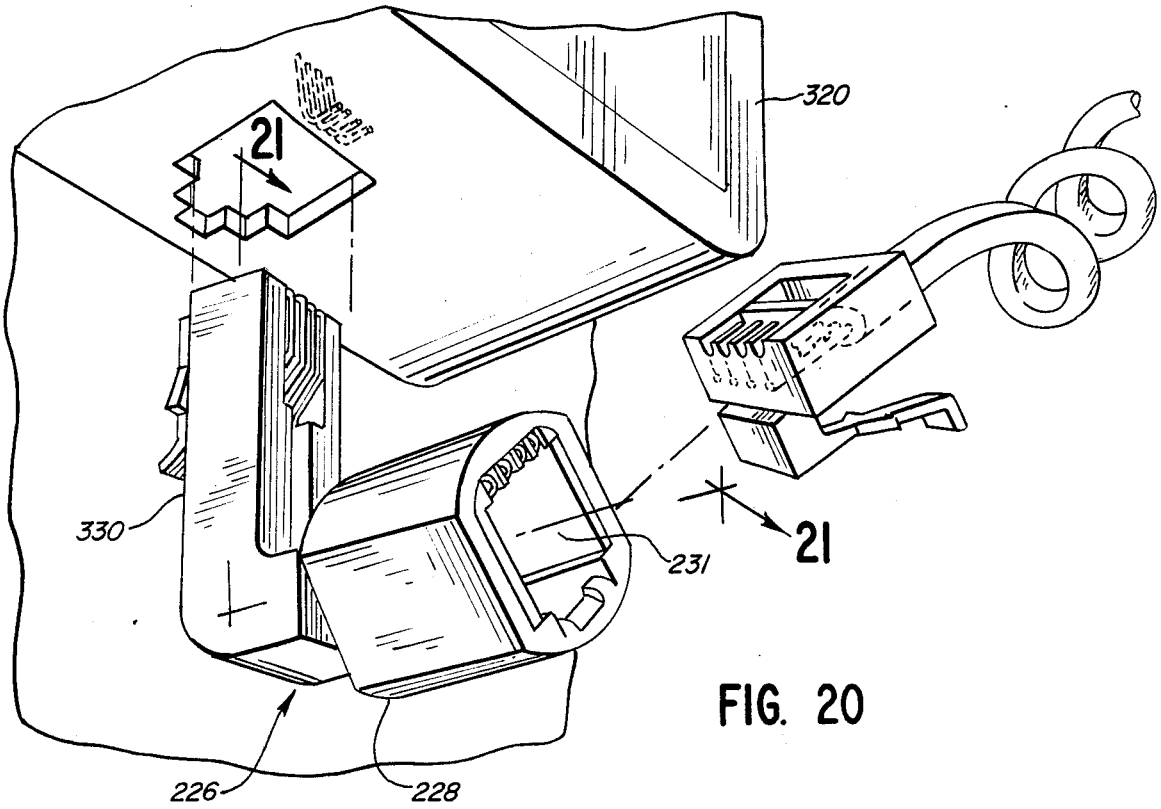
FIG. 20 is an exploded perspective view of a fifth embodiment of the rotary electrical connector apparatus.
Figure 21:
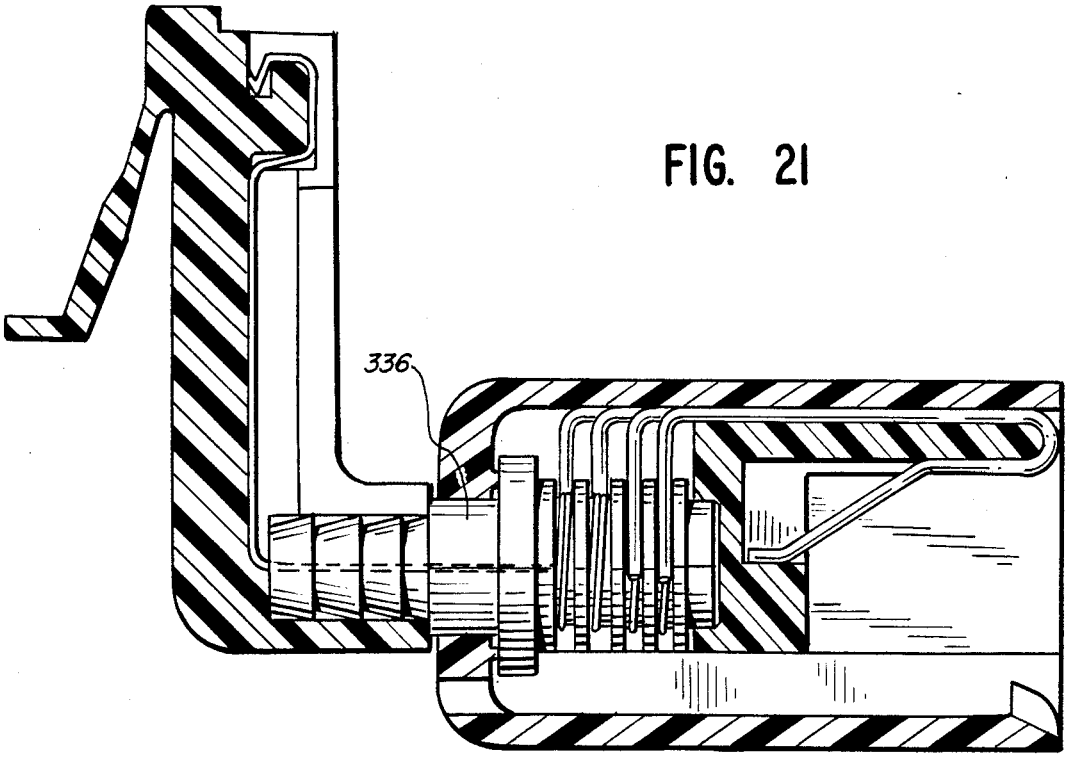
FIG. 21 is an elevational sectional view along Line 21—21 of FIG. 20

FIG. 20 and FIG. 21 disclose a fourth embodiment 226 of the apparatus of the present invention. The fourth embodiment is identical in construction, design, and assembly as the apparatus of the preferred embodiment (FIG. 1) except that plug 330 is disposed at a 90 degree angle to the longitudinal axis of rotation 231 of spindle 336. This design is most useful for wall mounted telephones where it is desired to attach the apparatus 226 to the telephone base 320. Thus, housing 228 lies in a plane parallel to the bottom of phone base 320 rather than perpendicular thereto as disclosed in the previously described embodiments of the apparatus of the subject invention.

Referring to FIG. 22 there is disclosed the telephone cord coupling apparatus 350 which couples telephone cord plug members 354 and 358. Coupling apparatus 350 comprises hollow housing 352. Hollow housing 352 comprises a bottom section 388, a top section 390, and two wall sections 392. Top section 390 comprises curved outside surface 394 and bottom section 388 comprises curved outside surface 398. Each wall section 392 comprises outside surface 396. Housing 350 further comprises first opposite end 368 and second opposite end 370. At first opposite end 368 there is plug opening 360 and at second opposite end 370 there is plug opening 362. Inside curved surface 400, a bottom section 388 is located on either side of inside flat bottom surface 402 which extends longitudinally through the length of bottom section 388. Locking grooves 404 are located laterally along each inside curved surface 400 near first end 368 and second end 370 of housing 352. Each locking groove 404 mates with locking projection 406 of first insert 364 and second insert 366. First end notches 380 are located at first end 368 and second end notches 382 are located at second opposite end 370. Top section 390 further comprises top portion 384 which is integral with and extends laterally accross the bottom surface 395 of top section 390. Top portion 384 comprises means for mounting each insert number in housing 252. Top surface 434 of each insert member lies contiguous to top portion 384 for a close fit.

Referring to FIG. 27 there is disclosed a perspective view of either one of the insert members 364 or 366. Both inserts are identical in structure and design. Inserts 364 and 366 each comprise means for mounting the electrical contact means or wires 372, 374, 376 and 378 within inserts 364 and 366 and with housing 352. Each insert comprises one end 408 and another opposite end 410. Each insert further comprises a laterally extending first or rear portion 412 adjacent said one end 408, and a longitudinally extending second or bottom portion 414 integral with said first portion 412, and terminating at the other end 410. First portion 412 comprises top surface 434, inside surface 420 and outside surface 418. Bottom portion 414 comprises inner side 416 and outer end 427. Bottom portion 414 further comprises curved bottom sides 422, disposed along either side of flat bottom surface 424. There are four longitudinally extending grooves 426 on flat bottom surface 424 (FIG. 23). There are four laterally extending grooves 428 located on outer side 427. Each groove 428 communicates with its respective groove 426 on outer end 427. There are four longitudinally extending grooves 430 located on inner side 416. Each groove 430 communicates with a respective lateral groove 428 on outer end 427. There are four laterally extending grooves 432 located along inside surface 420 of first portion 412. Each groove 432 is alined with their respective groove 430 on inside surface 420 and communicates therewith. As previously mentioned, each bottom portion 414 of each insert comprises a laterally disposed locking projection 406 which mates with its respective locking groove 404 at either end of housing 352.

Contact wires 372, 374, 376 and 378 have opposite ends and are releasably mounted to both inserts 364 and 366. The contact wires receive electrical energy from either plug 358 or plug 354 and transmit electrical energy to the other plug. Each contact wire comprises a first distal portion marked by "a"; a first contact section marked by "b"; a first connecting section marked by "c"; a first section marked by "d"; a second section marked by "e"; a second connecting section marked by "f"; a second contact section marked by "g"; and a second distal portion marked by "h". First section "d" is received within a respective longitudinally extending groove 426 on outside surface 424 of second portion 414 of insert 364. Second section "e" is intergal with said first section "d" and is received within a respective longitudinally extending groove 426 on the bottom surface 424 of second portion 414 of insert 366. First connecting section "c" is integral with said first section "d" and is received within a respective lateral groove 428 on outer end 427 of said second portion 414 of said insert 364. Second connecting section "f" is intergral with said second section "e," and is received within a respective lateral groove 428 on outer end 427 of said second portion 414 of insert 366. First contact section "b" is intergral with said first connecting section "c" and extends therefrom toward one end 408 of insert 364. First contact section "b" is normally at an angle having distal portion "a" thereof extending at least partially within laterally extending groove 432 on inner side 420 of first portion 412 of insert 364. Second contact section "g" is intergral with said second connecting section "f" and extends therefrom toward one end 408 of insert 366. Second contact section "g" is normally at an angle that has distal portion "h" thereof extending at least partially within said laterally extending groove 432 of inner side 420 of first portion 412 of insert 366. Each of said first contact section "b" and said second contact section "g" are composed of a resilient material capable of being elastically deformed in an outward direction toward said longitudinally extending grooves 430 on the inner side 416 of bottom portion 414 of each insert in response to the act of electrically connecting each insert with its respective electrical energy receiving means or electrical energy transmitting means. The longitudinally extending grooves 430 on inner side 416 of each bottom portion 414 of each insert, and the laterally extending grooves 432 on inner side 420 of each first portion 412 of each insert comprises means for accommodating each contact section when each section undergoes elastic deformation.

The component parts of the coupling apparatus are assembled by sliding each group of insert grooves into their respective contact wire portions. (See FIG. 23) Once assembled, each outside surface 408 of the first portion of each insert member will lie contiguous to the other outside surface 408 and top surface 434 of each insert will lie contiguous to bottom surface 397 of top portion 384 of housing 352. Locking grooves 404 and projections 406 of each insert member lock each insert member into place in housing 352.

Plug 358 and plug 354 are releasably mounted into openings 360 and 362 respectively in the same manner is previously described for plugs 4 and 120 of the rotary electrical connector apparatus 20. The length of a telephone handset cord can be increased to any desired length by using one or more of the coupling apparatus and an appropriate number of handset cords.

The foregoing description and drawing merely explains and illustrates the invention. The invention is not limited thereto except insofar as the independent claims are so limited and those who are skilled in the art and have the disclosure before them will be able to make modifications and variations therein without departing from the scope of the invention.

What is claimed is:

1. A spindle, composed of non-conducting material, for use with electrical conducting means for receiving and transmitting electrical energy, said spindle having an axis and comprising:

a pair of members each having an outer surface and an inner surface;

said members extending in an axial direction alongside each other;

one member being mounted on the other member to form said spindle;

a first end portion and a second end portion axially spaced on said spindle;

a first spindle section and a second spindle section in axially aligned relation on said spindle;

each spindle section having an outer surface defined by both outer surfaces of said two members which form the spindle;

said first spindle section having a circular cross sectional area; and, means on said outer surface of the first spindle section for holding a part of said electrical conducting means, and means on said inner surfaces of the two members cooperating to hold another part of said electrical conducting means, to transmit electrical energy through said first and second spindle sections.

2. A spindle as recited in claim 1 wherein;

said outer surface on said first spindle section comprises a plurality of peripheral grooves;

said inner surface of each spindle member comprises a plurality of parallel, longitudinally extending grooves and a plurality of parallel, laterally extending grooves lying perpendicular to said longitudinal grooves; and each lateral groove communicates with at least one peripheral groove.

3. A spindle as recited in claim 2 wherein:

said peripheral grooves comprise means for receiving said electrical conducting means;

said lateral grooves of each spindle member cooperate to form a plurality of lateral channels when said first and second members are assembled together;

said longitudinal grooves of each spindle member form a plurality of longitudinal channels when said first and second members are assembled together;

said lateral channels comprise means for containing said electrical conducting means; and said longitudinal channels comprise means for containing said electrical conducting means.

4. A spindle as recited in claim 3 wherein:

each longitudinal groove communicates with at least one lateral groove; and, each lateral groove communicates with at least one longitudinal groove.

5. A spindle as recited in claim 4 wherein:

said inner surface of each spindle member comprises four lateral grooves and four longitudinal grooves;

each of two lateral grooves communicates with two longitudinal grooves;

one lateral groove communicates with four longitudinal grooves;

each of two longitudinal grooves communicates with four lateral grooves; and, each of two longitudinal grooves communicates with two lateral grooves.

6. A rotary electrical connector apparatus for receiving electrical energy and for transmitting electrical energy, said apparatus comprising the spindle of claim 1 in combination with:

a hollow housing having opposite ends and a centrally located longitudinal axis of rotation;

each opposite end having an opening;

said spindle having a longitudinal axis of rotation coinciding with said longitudinal axis of the housing;

means on said housing and on said spindle cooperating to mount each of said spindle and said housing for rotation about said longitudinal axis independent of rotation of the other;

a plurality of electrical conducting means for conducting electrical energy through said spindle and rotatable therewith;

each of said electrical conducting means comprising a first portion contiguous to said outer surface of the spindle's first section and a second portion extending longitudinally through the spindle's second section;

a plurality of electrical contact means each having opposite ends;

means mounting said electrical contact means for rotational movement with said housing;

means at one end of each electrical contact means for electrically connecting said contact means with electrical energy receiving means;

and means at the other end of each electrical contact means for electrically engaging said electrical conducting means contiguous to the outer surface of the spindle's first section and for maintaining said electrical engagement during rotation of one of said spindle and said housing relative to the other;

said second portion of the electrical conducting means comprising means for electrically connecting said conducting means to electrical energy transmitting means.

7. A rotary, electrical connector as recited in claim 1 wherein said first and second spindle sections are located within said housing.

8. A rotary, electrical connector apparatus as recited in claim 6 wherein said second spindle section extends through and beyond the opening of one end of said housing.

9. A rotary, electrical coonnector apparatus as recited in claim 6 and comprising:

means mounted on the second spindle section for mechanically engaging the second spindle section with said electrical energy transmitting means and for effecting said electrical connection between said second portion of the conducting means and the electrical energy transmitting means as a result of said mechanical engagement;

said mechanical engaging means comprising means mounting said spindle for rotational movement, relative to said housing, together with said electrical energy transmitting means.

10. A rotary, electrical connector apparatus as recited in claim 6 wherein:

said mounting means for the electrical contact means comprises means for releasably mechanically engaging said housing with said electrical energy receiving means and for effecting said electrical connection between said contact means and the electrical energy receiving means as a result of said mechanical engagement;

said last recited mechanical engaging means comprising means mounting said housing for rotational movement, relative to said spindle, together with said electrical energy receiving means.

11. A rotary, electrical connector apparatus as recited in claim 6 wherein:

said first spindle section comprises a plurality of peripheral grooves each receiving a first portion of a respective electrical conducting means.

12. A rotary, electrical connector apparatus as recited in claim 11 wherein said means mounting the spindle and the housing for said independent rotation comprises:

wall means around said opening at said one end of the housing;

thrust bearing means on said wall means for engaging said spindle at the junction of the first and second spindle sections;

said thrust bearing means and said wall means also constituting said means for preventing said longitudinal movement of the first spindle section.

13. A rotary, electrical connector apparatus as recited in claim 11 wherein:

said means at the other end of each electrical contact means comprises means for engaging within a respective one of said peripheral grooves on the first spindle section; and said electrical contact means is composed of resilient material which normally urges said other end into said groove to electrically engage the first portion of the electrical conducting means therein.

14. A rotary, electrical connector apparatus as recited in claim 6 wherein:

said mounting means for the electrical contact means has one end adjacent said first end portion of the spindle and recess means at said one end of said mounting means, for receiving said first end portion of the spindle and for permitting rotation of said first end portion within the recess means.

15. A rotary, electrical connector apparatus as recited in claim 14 wherein said mounting means for the electrical contact means comprises:

a laterally extending first portion adjacent said one end of said mounting means;

a longitudinally extending second portion integral with said first portion and terminating at another end opposite said one end;

each of said first and second portions having outer and inner sides;

said recess means being located at the outer side of said first portion:

a plurality of longitudinally extending grooves on the outer side of said second portion, each for receiving a portion of a respective electrical contact means;

a plurality of lateral grooves at said other end of the second portion, each communicating with a respective longitudinal groove on the outer side of said second portion;

a plurality of longitudinally extending grooves on the inner side of said second portion, each communicating with a lateral groove at said other end of the second portion and, a plurality of laterally extending grooves on the inner side of said first portion, each being aligned with one of said longitudinally extending grooves on the inner side of said second portion.

16. A rotary, electrical connector apparatus as recited in claim 15 wherein each of said electrical contact means comprises:

a first portion received within a respective longitudinally extending groove on the outer side of said second portion of the mounting means;

a connecting portion integral with said first portion and received within a respective lateral groove at said other end of said second portion of the mounting means;

a contact portion integral with said connecting portion and extending therefrom toward said one end of the mounting means normally at an angle having a distal part thereof extending at least partially within said groove on the inner side of said first portion mounting means;

said contact portion being composed of resilient material capable of being elastically deformed in an outward direction toward said longitudinally extending grooves on the inner side of said first portion of the mounting means, in response to the act of electrically connecting said electrical contact means with said electrical energy receiving means;

said longitudinally extending grooves on the inner side of said first portion and said laterally extending grooves on the inner side of said second portion of the mounting means comprising means for accommodating said contact portion when the latter undergoes said elastic deformation.

17. A rotary, electrical connector apparatus as recited in claim 16 wherein:

said means at the other end of each electrical contact means comprises a terminal portion integral with said longitudinally extending first portion of the electrical contact means and extending laterally from said first portion to tangentially engage the outer surface of the spindle's first portion.

18. A rotary, electrical connector apparatus as recited in claim 6 wherein:

said outer surface on said first spindle section comprises a plurality of peripheral grooves;

said inner surface of each spindle member comprises a plurality of parallel, longitudinally extending grooves and a plurality of parallel, laterally extending grooves lying perpendicular to said longitudinal grooves; and, each lateral groove communicates with at least one peripheral groove.

19. A rotary, electrical connector apparatus as recited in claim 18 wherein:

each first portion of each electrical conducting means lies contiguous to the outer surface of each peripheral groove;

said lateral grooves of each spindle member cooperate to form a plurality of lateral channels when said first and second members are assembled together;

said longitudinal grooves of each spindle member cooperate to form a plurality of longitudinal channels when said first and second members are assembled together;

each second portion of each electrical conducting means lies within a longitudinal channel and extends beyond said second end portion of said spindle; and, each of said electrical conducting means comprises a third portion, perpendicular to said second portion, and which lies within a lateral channel.

20. A rotary electrical connector apparatus as recited in claim 6 wherein said electrical conducting connecting means comprises means disposed perpendicular to the axis of rotation of said spindle for electrically connecting said conducting means to said electrical energy transmitting means.

21. An electrical coupling apparatus for receiving electrical energy and for transmitting electrical energy, said apparatus comprising:

a hollow housing having a mid-portion and opposite ends;

each opposite end having an opening;

a plurality of electrical contact means each having opposite ends located within said housing;

first insert means at one end of said housing for releasably mechanically engaging said housing with electrical energy receiving means and for electrically connecting said electrical contact means and said electrical energy receiving means as a result of said mechanical engagement;

second insert means at the other end of said housing for releasably mechanically engaging said housing with electrical energy transmitting means and for electrically connecting said electrical contact means and said electrical energy transmitting means as a result of said mechanical engagement;

said first insert means having one end adjacent said mid-portion of the housing and a laterally extending first portion adjacent said one end of said first insert means;

a longitudinally extending second portion integral with said first portion and terminating at another end of said first insert opposite said one end thereof and adjacent one opening of said housing;

each of said first and second portions having outer and inner sides;

a plurality of longitudinally extending grooves on the outer side of said second portion, each for receiving a portion of a respective electrical contact means;

a plurality of lateral grooves at said other end of the second portion, each communicating with a respective longitudinal groove on the outer side of said second portion;

a plurality of longitudinally extending grooves on the inner side of said second portion, each communicating with a lateral groove at the other end of the second portion; and, a plurality of laterally extending grooves on the inner side of said first portion, each being aligned with one of said longitudinally extending grooves on the inner side of said second portion.

22. An electrical coupling apparatus as recited in claim 21 wherein said second insert means comprises:

one end adjacent said mid-portion of the housing;

a laterally extending first portion adjacent said one end of said second insert means;

a longitudinally extending second portion integral with said first portion and terminating at another end of said second insert means opposite said one end thereof and adjacent another opening of said housing;

each of said first and second portions having outer and inner sides;

a plurality of longitudinally extending grooves on the outer side of said second portion, each for receiving a portion of a respective electrical contact means;

a plurality of lateral grooves at said other end of the second portion, each communicating with a respective longitudinal groove on the outer side of said second portion;

a plurality of longitudinally extending grooves on the inner side of said second portion, each communicating with a lateral groove at the other end of the second portion; and, a plurality of laterally extending grooves on the inner side of said first portion, each being aligned with one of said longitudinally extending grooves on the inner side of said second portion.

23. An electrical coupling apparatus as recited in claim 22 wherein:

said outer side of said first portion of said first insert means lies substantially contiguous to said outer side of said first portion of said second insert means; and, said housing comprises means for mounting each of said insert means to prevent the longitudinal movement of each insert means out of its respective opening.

24. An electrical coupling apparatus as recited in claim 22 wherein each of said electrical contact means comprises:

a first section received within a respective longitudinally extending groove on the outer side of said second portion of said first insert means;

a second section integral with said first section and received within a respective longitudinally extending groove on the outer side of said second portion of said first insert means;

a first connecting section integral with said first section and received within a respective lateral groove at said other end of said second portion of said first insert means;

a second connecting section integral with said second section and received within a respective lateral groove at said other end of said second portion of said second insert means;

a first contact section integral with said first connecting section and extending therefrom toward said one end of the first insert means normally at an angle and having a distal part thereof extending at least partially within said laterally extending groove on the inner side of said first portion of said first insert means;

a second contact section integral with said second connecting section and extending therefrom toward said one end of the second insert means normally at an angle and having a distal part thereof extending at least partially within said laterally extending groove on the inner side of said first portion of said second insert means;

each of said first and second contact sections being composed of resilient material capable of being elastically deformed in an outward direction toward said longitudinally extending grooves on the inner side of said first portion of each respective insert means, in response to the act of electrically connecting each of said electrical contact means with its respective electrical energy receiving means and electrical energy transmitting means; and said longitudinally extending grooves on the inner side of each first portion and said laterally extending grooves on the inner side of each second portion of each respective insert means comprises means for accommodating each contact section when the latter undergoes said elastic deformation.

25. A spindle assembly for receiving and transmitting electrical energy, said spindle assembly comprising:

a first spindle section and a second spindle section each composed of non-conducting material;

said first spindle section having a substantially solid, circular cross-sectional area and an axis of rotation;

an outer surface on said first spindle section having four peripheral grooves;

and electrical conducting means associated with said spindle sections;

said electrical conducting means comprising four circular portions each received in a respective peripheral groove;

each of said circular portions being integral with a respective lateral portion of said electrical conducting means;

each of said lateral portions being integral with a respective longitudinal portion of said electrical conducting means;

each lateral portion extending through said first spindle section transversely to said axis of rotation;

each longitudinal portion extending through said first and second spindle sections transversely to the lateral portion with which said longitudinal portion is integral;

all of said longitudinal portions lying in a single plane;

all of said lateral portions lying in the same plane in which all of said longitudinal portions lie.

26. A spindle assembly as recited in claim 25 wherein:

each of said integral circular, lateral and longitudinal portions is formed from a single piece of electrical conducting material.

27. A spindle assembly as recited in claim 26 and comprising:

a plurality of extended portions each integral with a respective longitudinal portion of the electrical conducting means and formed from said single piece of electrical conducting material;

a connector plug mounted on said second spindle section;

said connector plug having several series of communicating grooves;

each extended portion of said electrical conducting means being received in a respective series of said communicating grooves.

28. A spindle assembly for receiving and transmitting electrical energy, said spindle assembly comprising:

a first spindle section and a second spindle section each composed of non-conducting material;

said first spindle section having a substantially solid, circular cross-sectional area and an axis of rotation;

an outer surface on said first spindle section having a plurality of peripheral grooves;

and electrical conducting means associated with said spindle sections;

said electrical conducting means comprising a plurality of circular portions each received in a respective peripheral groove;

each of said circular portions being integral with a respective lateral portion of said electrical conducting means;

each of said lateral portions being integral with a respective longitudinal portion of said electrical conducting means;

each lateral portion extending through said first spindle section transversely to said axis of rotation;

each longitudinal portion extending through said first and second spindle sections transversely to the lateral portion with which said longitudinal portion is integral;

a plurality of extended portions each integral with a respective longitudinal portion;

a connector plug mounted on said second spindle section;

said connector plug having several series of communicating grooves;

each extended portion of said electrical conducting means being received in a respective series of said communicating grooves;

each of said integral circular, lateral, longitudinal and extended portions being formed from a single piece of electrical conducting material.

29. A spindle assembly as recited in claim 28 wherein:

all of said longitudinal portions lie in a single plane;

and all of said lateral portions lie in the same plane in which all of said longitudinal portions lie.

30. A spindle assembly as recited in claim 28 wherein:

said outer surface on said first spindle section has four peripheral grooves each receiving a respective circular portion of the electrical conducting means.

31. A spindle assembly for receiving and transmitting electrical energy, said spindle assembly comprising:

a first spindle section and a second spindle section each composed of non-conducting material;

said first spindle section having a substantially solid, circular cross-sectional area and an axis of rotation;

an outer surface on said first spindle section having a plurality of peripheral grooves;

and electrical conducting means associated with said spindle sections;

said electrical conducting means comprising a plurality of circular portions each received in a respective peripheral groove;

each of said circular portions being integral with a respective lateral portion of said electrical conducting means;

each of said lateral portions being integral with a respective longitudinal portion of said electrical conducting means;

each lateral portion extending through said first spindle section transversely to said axis of rotation;

each longitudinal portion extending through said first and second spindle sections transversely to the lateral portion with which said longitudinal portion is integral;

each of said integral circular, lateral and longitudinal portions being formed from a single piece of electrical conducting material.

* * * * *